US005630595A

United States Patent [19]

Perner

[11] Patent Number: 5,630,595

[45] Date of Patent: May 20, 1997

[54] BRAKING DEVICE FOR ROLLER SKATES

[75] Inventor: Johann Perner, Graz, Austria

[73] Assignee: Koflach Sport Gesellschaft m.b.H. & Co. KG, Austria

[21] Appl. No.: 347,384

[22] PCT Filed: Apr. 6, 1994

[86] PCT No.: PCT/AT94/00041

§ 371 Date: Dec. 5, 1994

§ 102(e) Date: Dec. 5, 1994

[87] PCT Pub. No.: WO94/22542

PCT Pub. Date: Oct. 13, 1994

[30] Foreign Application Priority Data

Apr. 6, 1993 [AT] Austria ..... 700/93

[51] Int. Cl.[6] ..... A63C 17/14

[52] U.S. Cl. ..... 280/11.2; 280/11.22

[58] Field of Search ..... 280/11.19, 11.2, 280/11.22, 11.23, 11.27, 11.28, 87.042; 188/5

[56] References Cited

U.S. PATENT DOCUMENTS

| | | | |
|---|---|---|---|
| 2,744,759 | 5/1956 | Sternbergh | 280/11.2 |
| 4,181,227 | 1/1980 | Balstad | 280/11.2 |
| 4,807,893 | 2/1989 | Huang . | |
| 5,067,736 | 11/1991 | Olson etal. | 280/11.2 |
| 5,088,748 | 2/1992 | Koselka et al. | 280/11.2 |
| 5,183,275 | 2/1993 | Hoskin | 280/11.2 |
| 5,192,099 | 3/1993 | Riutta | 280/11.2 |
| 5,257,795 | 11/1993 | Babcock | 280/11.2 |

FOREIGN PATENT DOCUMENTS

| | | |
|---|---|---|
| 1179697 | 12/1984 | Canada . |
| 0379906 | 8/1990 | European Pat. Off. . |
| 3013540A1 | 10/1981 | Germany . |
| 3017762A1 | 11/1981 | Germany . |
| 3041042A1 | 6/1982 | Germany . |
| 11117 | 4/1910 | United Kingdom . |
| WO82/00770 | 3/1982 | WIPO . |

*Primary Examiner*—Richard M. Camby
*Attorney, Agent, or Firm*—Nixon & Vanderhye P.C.

[57] ABSTRACT

In a braking device for roller skates (1), especially in-line (i.e. "single-track") roller skates, with a brake block (5) which is removably secured to the frame (2) or the boot (1), the brake block is mounted on the frame (2) or boot so as to pivot against the force of a spring (6), thus permitting gentle application of the brake. At the same time, maximum braking is possible if needed, due to a projecting part of the brake block (5) which is supported in a guide and can be applied to or moved against a roller, without risk of putting the skater off balance during braking.

14 Claims, 6 Drawing Sheets

BRAKING DEVICE FOR ROLLER SKATES

This invention relates to braking device for roller skates, particularly in-line (i.e. "single-track") roller skates, comprising a removable brake block pivotably connected to the frame or skate against the force of a spring, with the pivot axis of said brake block being essentially parallel to the axis of the rollers.

Roller-skate braking devices in which brake blocks, arranged between the rollers and the sole, can be shifted in the longitudinal direction of the skate so as to co-act directly with the rollers, can be inferred from e.g. U.S. Pat. No. 5,143,387 or U.S. Pat. No. 5,171,032. Whereas the brake block in U.S. Pat. No. 5,143,387 is shifted by curling the toes inside the boot, U.S. Pat. No. 5,171,032 on the other hand discloses a sheathed cable with a handle for shifting the brake block, as is common with motor-cycle brakes, for example. In both these known devices the brake blocks, similarly to motor-cycle brakes, only act directly on the rollers.

Conventional roller skates have removable brake blocks mounted rigidly on the frame or boot; the braking effect is achieved by positioning the roller skate relative to the ground in such a way that, instead of the rollers, the brake block comes into frictional connection with the ground. This conventional method of braking roller-skates has become generally established; however, the braking effect caused by tilting the brake block relative to the ground and pressing it against the ground can occur with varying abruptness. A disadvantage with known roller-skate braking devices with this type of removable brake block—which can for example be designed as a stopper connected to the frame or boot with screws—is thus the fact that the braking effect can by no means be applied gradually, but commences relatively abruptly, and thus a controlled, gentle slowdown is not readily possible, although on the other hand strong braking-power is available if required.

In another design, disclosed in GB-PS 11,117 (A.D. 1909), a projecting part is connected to a brake block, which can be turned pivotally against the force of a tension spring, whereupon the projecting part co-acts with the rollers. The projecting part is pressed against the rollers more or less resiliently depending on the possible choice of type and gauge of material used for the connecting part, so that an additional, but limited, braking force is exerted, which only becomes great enough to be effective in the case of multi-track roller skates and with braking applied simultaneously to a number of rollers.

The present invention aims to further develop a braking device of the type mentioned initially, using conventional stoppers and brake blocks, so that on the one hand a gentle commencement of the braking process is possible and, on the other hand, maximum possible braking force is available in case of need, but without there being any danger of the roller-skater being put off balance by the braking. In fact, whereas roller-skates with braking applied only to the rollers require the weight to be shifted simultaneously with the commencement of the braking operation, in order to prevent stumbling and hence falling, such weight distribution always occurs automatically with the use of stopper-type brake blocks, thereby considerably reducing the risk of a fall. To achieve this aim, the design according to the invention, starting out from the design of roller-skate with brake block described initially, consists essentially in that the brake block, or the holder-part for the brake block, is guided in or on a guide located at a distance from the pivot axis, and that when the brake block is turned on its pivot axis, during which operation it is supported in or on the guide, the brake block or a projecting part connected to the brake block comes into frictional contact with the running surface of at least one of the rollers. Such a design is advantageous in that once the force of the spring has been overcome, and thus suitably-gradual commencement of the braking operation has occurred, with the required weight-transfer having been performed at the same time, strong braking forces can then be applied, due to the supporting of the projecting part in or on the guide; and thus significantly greater braking forces can in fact be applied than is possible with prior-art braking devices.

In the design according to the invention the brake block is connected to a holder-part comprising a seat for a compression-spring. In principle, brake blocks of the same kind as those used in conventional devices can be used in the device according to the invention; in which case these brake blocks can be connected by means of screws to the pivotable holder, which must comprise the seat for the compression-spring.

In a particularly simple manner, structurally speaking, it is possible to achieve a further increase in braking force and a further improvement in the desired area of contact, together with an evening-out of the braking effect and of the wear on the brake block, simply by arranging the brake block or the holder part for said brake block in a guide slot or slideway located at a distance from the pivot axis.

In addition to the smoothing and gentle commencement of the braking process, the design according to the invention, comprising a brake shoe pivotable against the force of a spring, makes it possible to avoid points of discontinuity in the braking effect while at the same time providing maximum possible braking forces. Because braking is also applied simultaneously or supplementarily to at least one roller of the roller skate that is in contact with the ground, the braking effect is essentially independent of the characteristics and grip of the ground, with the application of braking-forces being triggered not by extra measures but merely by tilting the roller skate to apply the brake block to the ground.

In this regard, a design in which the projecting part connected to the brake block is contoured to partially surround the roller, on the side of said connecting part that faces the roller, is particularly reliable and at the same time reduces wear on the various brake parts required.

An additional increase in the braking effect and improved take-up of the reaction forces and supporting forces can be achieved as follows: the projecting part is arranged movably in a guide running at right angles to the longitudinal axis of the roller skate, and can be slid along in the guide, against an inclined surface, when the brake block is turned on its pivot axis. With this design, the braking force of the projecting part is further increased due to its close contact with the undersurface of the sole and the inclined surface. The same applies to the shifting and pivoting of an additional brake block, which in the relevant brake-position is additionally supported against the underside of the sole and co-acts with the roller in the manner of a wedge. In this regard, the design can advantageously be such that the pivot axis of the brake block and its holder either coincides with the axis of the rear roller or is located to the rear of said roller axis.

A particularly good smoothing of the braking effect can be achieved by using a compression-spring with a progressive spring action, which can be achieved e.g. by arranging two separate compression-springs with different hardness characteristics coaxially, with the stronger spring only coming into action after the weaker one has been compressed a certain distance.

The invention will now be described in greater detail with reference to the examples depicted diagrammatically in the drawing, in which.

Figure 4:
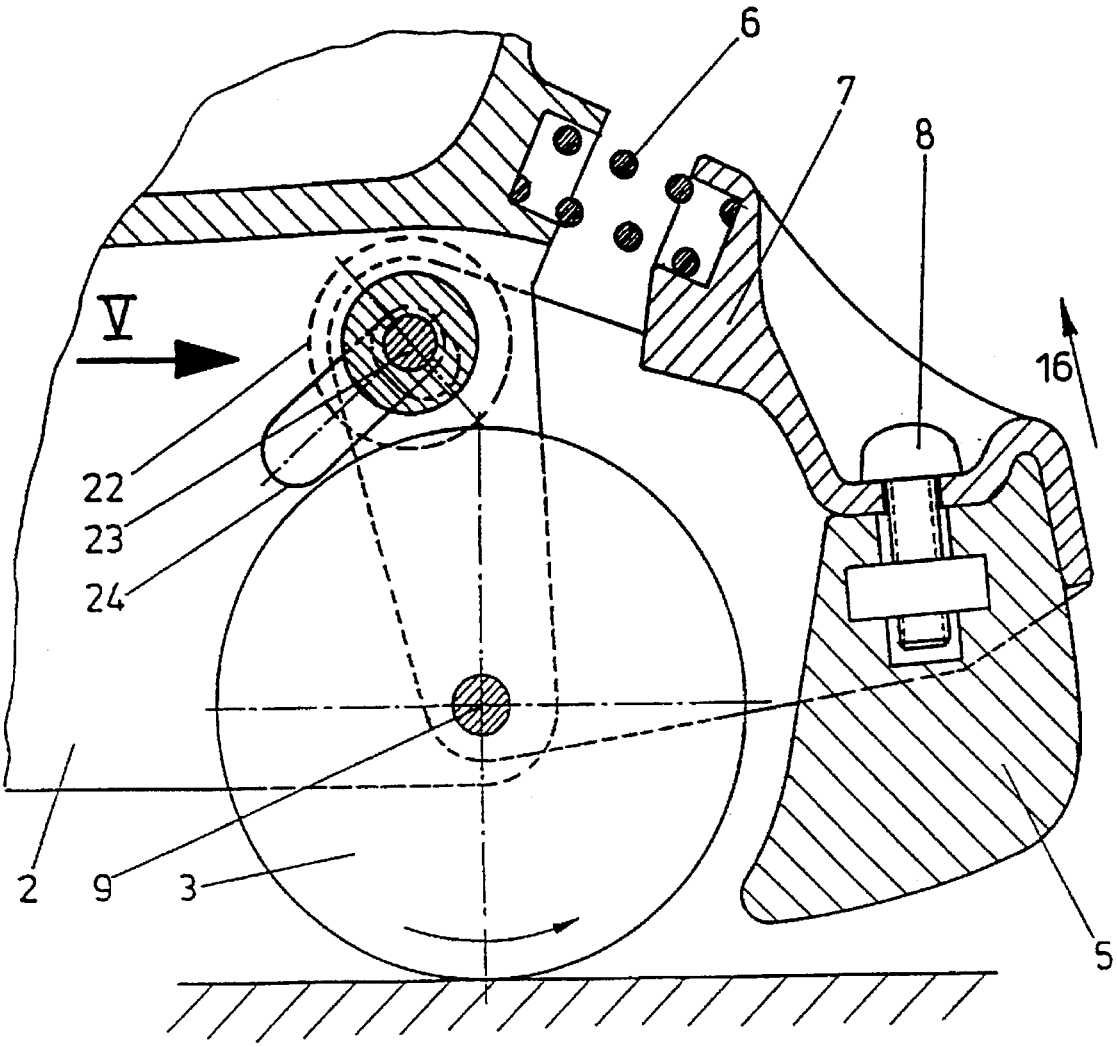
Figure 5:
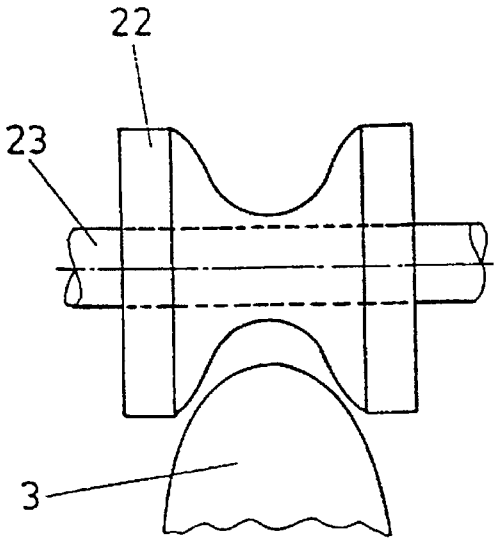
Figure 6:
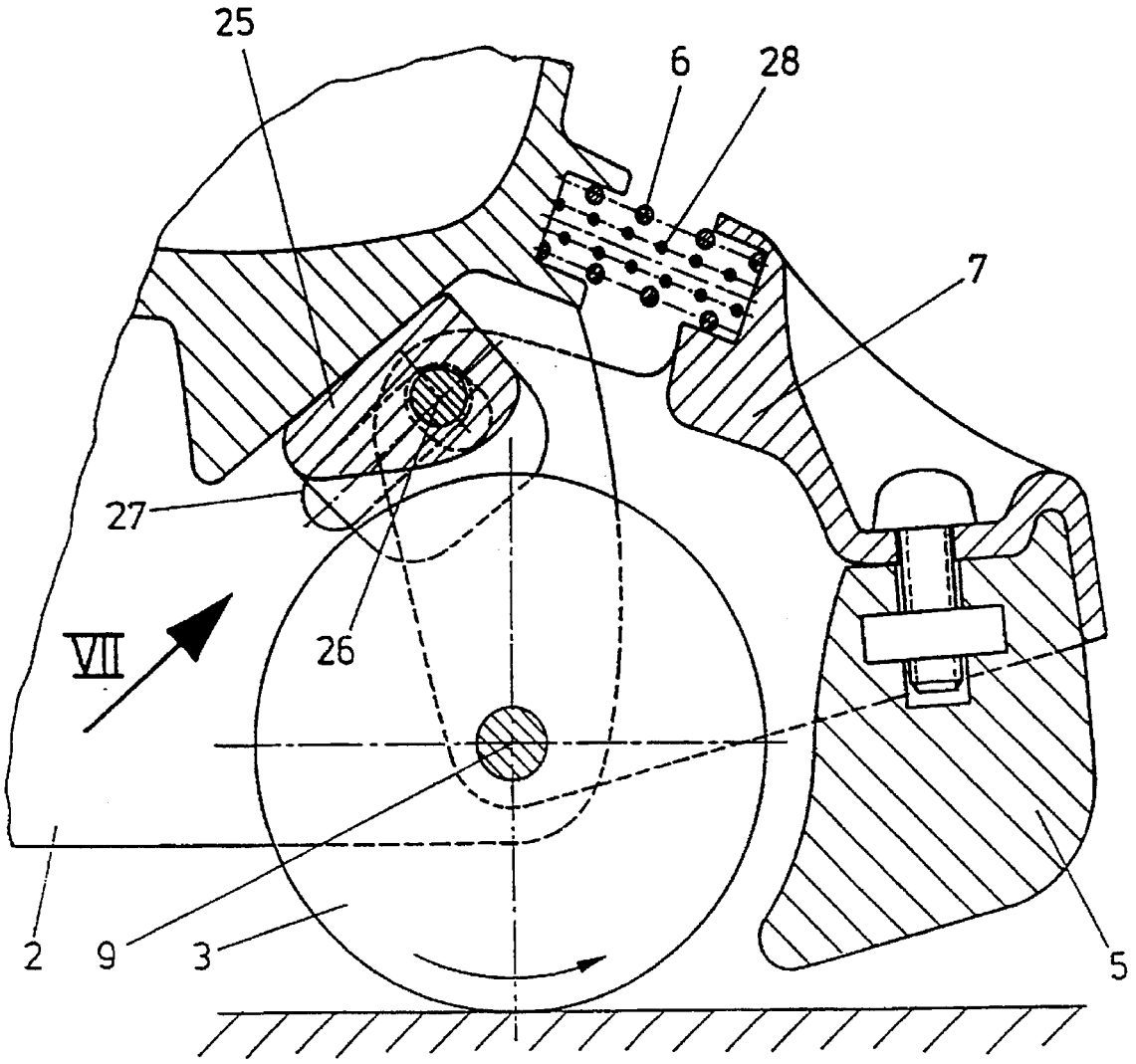
Figure 7:
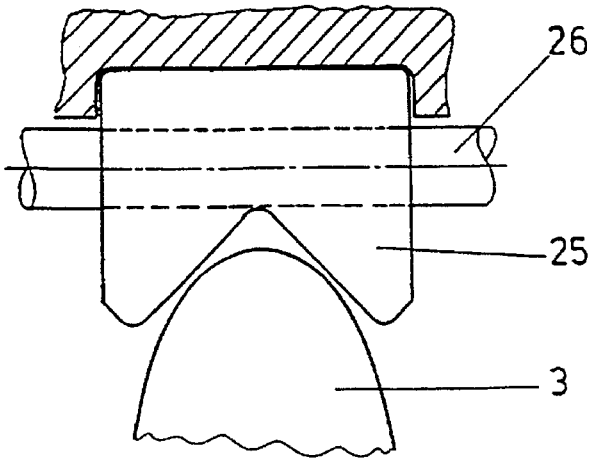

FIG. 4 again shows an analogous view of another modified form of embodiment of a braking device according to the invention;

FIG. 5 is a detail view, looking in the direction of arrow V in FIG. 4;

FIG. 6 again shows an enlarged and partly-sectional view of another modified form of embodiment of a braking device according to the invention;

FIG. 7 is a detail view looking in the direction of arrow VII in FIG. 6; and

FIG. 8 is again an enlarged, partly-sectional view of another modified form of embodiment of a braking device according to the invention.

Figure 1:
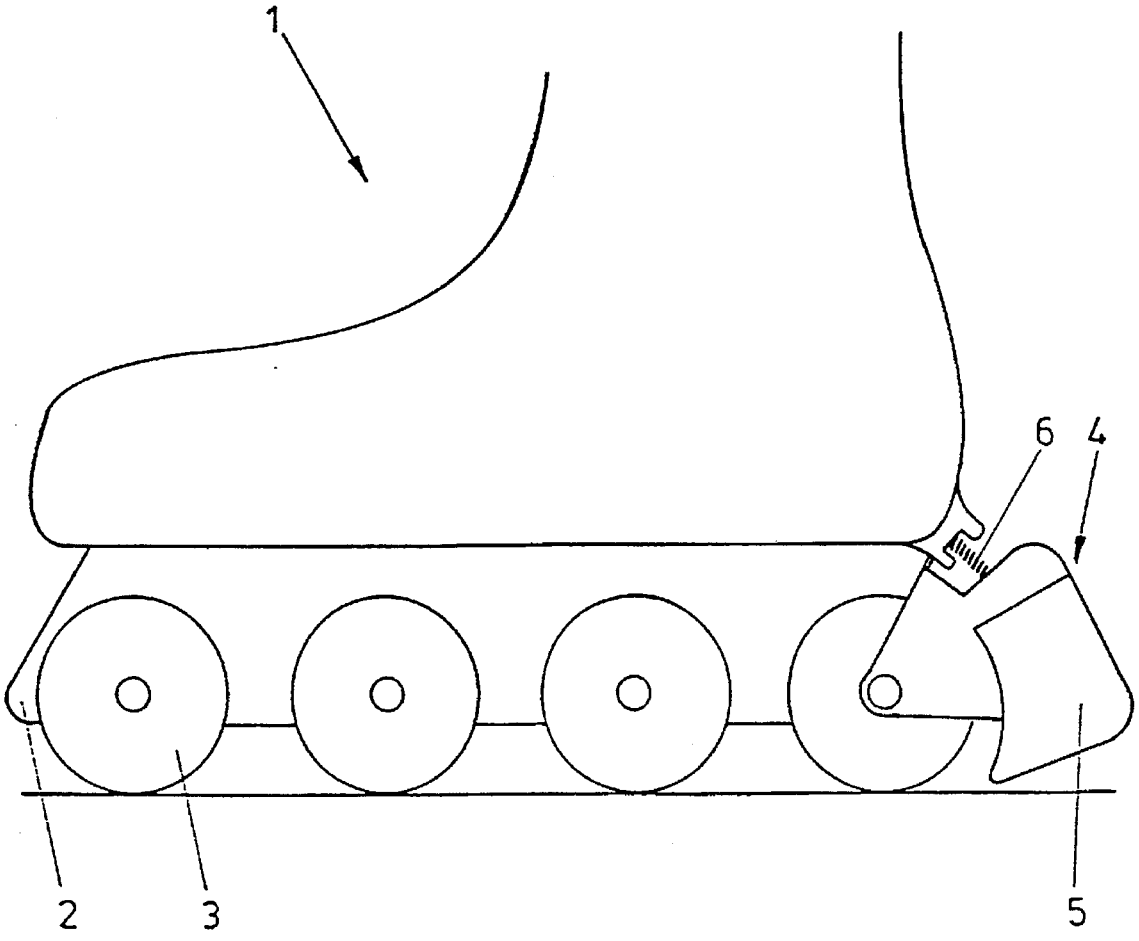
FIG. 1 is a diagrammatic side view of a roller skate with the braking device according to the invention.

FIG. 1 shows a roller skate, designated globally as 1, with a frame 2 on which a number of rollers or wheels 3 are rotatably mounted. In the region of the heel of the roller skate 1, there is a braking device, designated globally as 4, in which a brake block 5, removably connected to the roller skate and the frame 2, is pivotally mounted on the frame 2 and shell 1 of the roller skate, against the force of a spring 6.

The frame 2 can e.g. be integral with the shell 1 of the roller skate.

Figure 2:
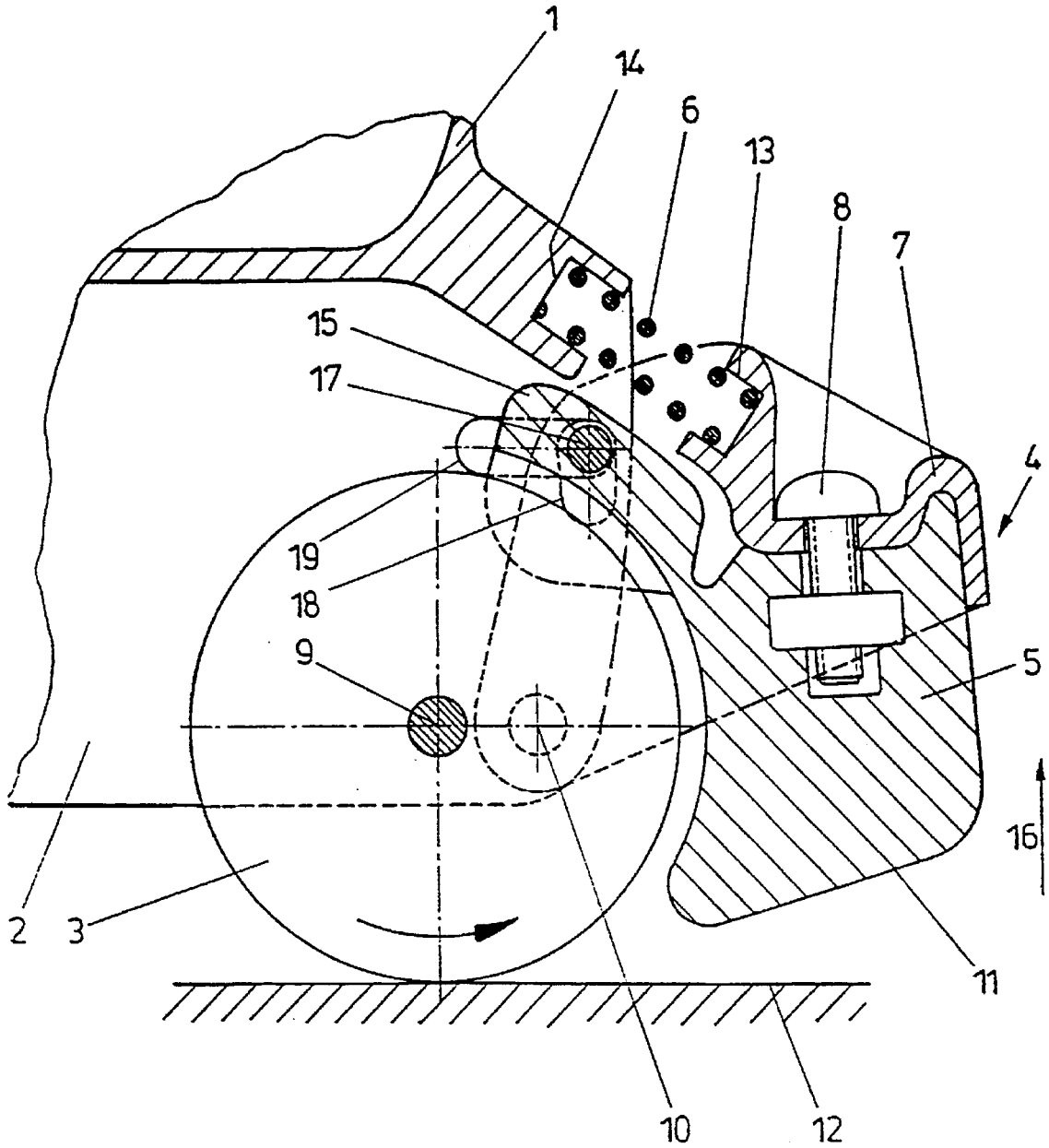
FIG. 2 is an enlarged representation of a partial section through one form of embodiment of a braking device according to the invention.

In the enlarged representation in FIG. 2, the bearing of the braking device 4 in the region of the rear wheel 3 is shown in detail. The brake block 5 is attached to a holder 7 by means of a screw 8, and the holder 7 with the brake block 5 is pivotally mounted on the frame 2 about an axis 10 parallel to the wheel axis 9. When the friction surface 11 of the brake block is brought into contact with the ground 12, the holder 7 and brake block 5 are moved against the force of the compression-spring 6, and a feeling of security is imparted by the gentle commencement of the braking process achievable due to the spring. The holder 7 has a spring seat 13 to receive the compression-spring 6. This spring is held to the frame and shell in a recess 14, which forms the second spring seat.

A projecting part 15 is connected to the brake block 5, and during the performance of a braking operation by pivoting of the brake block 5 and the holder 7 in the direction of the arrow 16, the projecting part 15 comes into frictional contact with the running surface of the rear wheel 3, so that braking occurs not only as a result of the contact between the braking surface 11 of the brake block 5 and the ground 12 but also due to the pressing of the projecting part 15 against the wheel 3. During this operation, the projecting part 15 is guided by means of a bolt 17 in a guide-slot formed by two elongated holes 18, 19.

Figure 3:
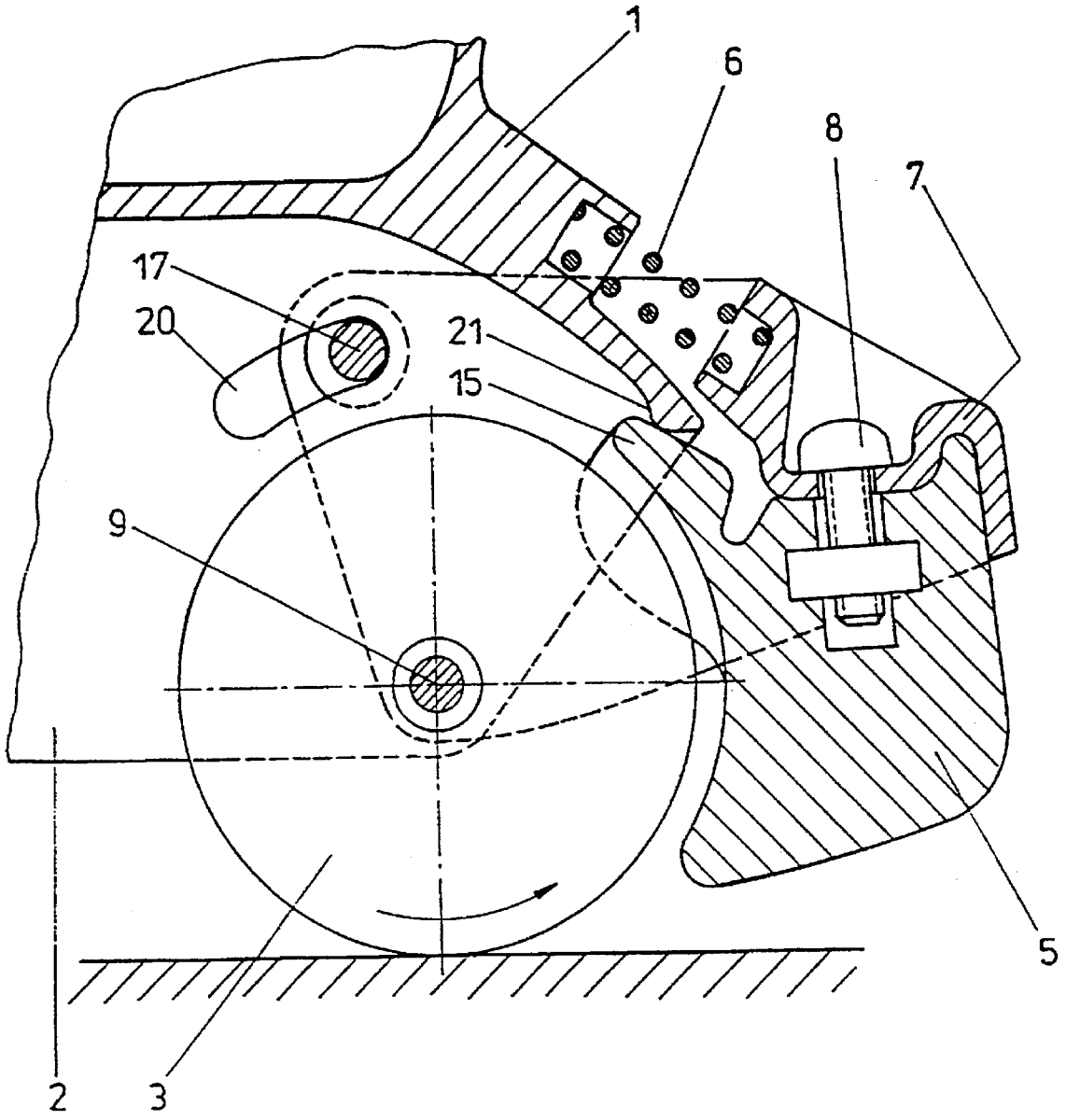
FIG. 3 shows a modified form of embodiment of the braking device according to the invention, in a view analogous to that shown in FIG. 2.

FIG. 3 shows a similar form of embodiment of the invention, in which the brake block 5 is again removably mounted on a holder 7 and a dampened commencement of the braking operation occurs, against the force of the compression-spring 6, when the brake block 5 and holder 7 are turned on their pivot axis. In this embodiment, the pivot axis of the holder 7 coincides with the wheel axis 9 of the rear wheel 3, and instead of the intersecting slots 18 and 19, a curved slot 20 is provided whose centre of curvature corresponds to the common axis 4 of the wheel 3 and the holder 7. Here too, during the performance of a braking operation, the projecting part 15 again comes into frictional contact with the running surface of the rear wheel 3. The boundary of the slot 20 on the one hand and a projection 21 on the frame on the other hand serve to limit the travel of the brake block 5.

In the embodiment shown in FIGS. 4 and 5, a braking roller 22 is mounted on the holder 7 of the brake block 5 in such a way that it can rotate about a shaft 23. The shaft 23 is guided in a slot 24, so that when the brake block 5 and holder 7 pivot in the direction of the arrow 16 during a braking operation, the roller 22 is brought into contact with the running surface of the wheel 3, as can be seen clearly in FIG. 5. The contour of the braking roller 22 is such that it surrounds the rear roller or wheel 3 at least partially. To provide a suitable braking effect, the braking roller 22 is mounted on the holder in such a way that it can only rotate with difficulty. By suitably arranging the slot 24 serving as a guide for the shaft 23 of the braking roller, the pressure with which the braking roller is pressed against the wheel can be increased according to the requirements, with progressive compression of the compression-spring.

In a similar embodiment shown in FIGS. 6 and 7, an additional brake shoe 25 is mounted on the holder 7, and the holder 7 and the seating-element for the additional brake shoe 25 are guided by a bolt 26 in a guide-slot 27. As can be clearly seen in FIG. 7 in particular, the additional brake shoe 25 partly surrounds the rear wheel 3 so that in this embodiment too, when the brake block 5 and the holder 7 are turned on their pivot axis, braking of the rear wheel 3 also occurs through the pressing of the brake shoe onto the running surface of the wheel 3. In addition to the compression-spring 6, a second compression-spring 28 with different spring characteristics is arranged coaxially to said compression-spring 6, thus enabling a progressive overall spring action to be achieved.

Figure 8:
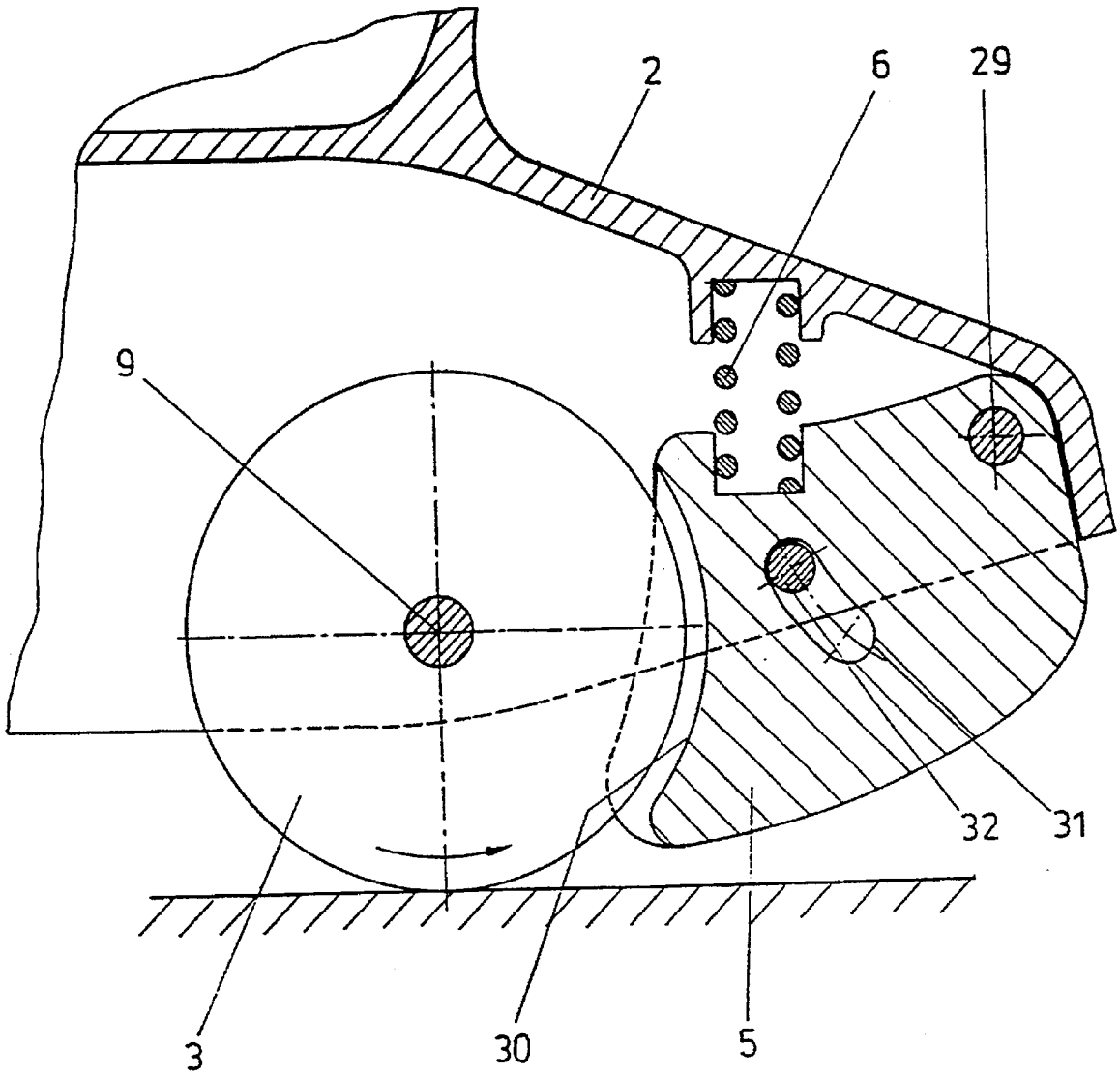

In the form of embodiment shown in FIG. 8, when the brake block 5 is turned on a pivot axis 29 arranged to the rear of the axis of rotation 9 of the rear wheel, against the force of the compression-spring 6, frictional contact occurs directly between the surface 30 of the brake block 5 and the running surface of the rear wheel 3. A guide slot 31 is again provided to guide the brake block 5, and there is a guide bolt marked 32.

The claims defining the invention are as follows:

1. A braking device for a roller skate comprising a boot and a frame, said frame mounting rollers for rotation about respective parallel roller axes, said braking device comprising:

an actuation block including a bottom contact surface, said actuation block detachably mounted to one of said frame and said boot, for pivotal movement about a pivot axis from an inoperative position to an operative position against a force of a spring located between said actuation block and one of said frame and said boot, acting to return said actuation block to the inoperative position, said pivot axis being generally parallel to the roller axes;

a braking member associated with said actuation block and arranged to frictionally contact at least one of said rollers when said actuation block is pivoted to its operative braking position; and a guideway provided in at least one of said frame and said actuation block, cooperating with a shaft extending through said frame and parallel to said pivot axis to guide and support said actuation block and said braking member during pivotal movement of said actuation block and said braking member relative to said frame and in the operative braking position thereof.

2. A braking device as claimed in claim 1, wherein said spring comprises a compression spring.

3. A braking device as claimed in claim 2, further comprising a carrier carrying said actuation block, said carrier having a spring seat wherein an end of said compression spring is seated, another end of said compression spring seated in a recess one of in said frame and said boot.

4. A braking device as claimed in claim 2 or 3, wherein said compression spring has a progressive spring characteristic.

5. A braking device a claimed in claim 1, wherein said braking member includes a braking surface facing said at least one roller and having a contour partially surrounding said at least one roller.

6. A braking device as claimed in claim 1, wherein said skate defines a longitudinal direction, and said guideway comprises a guide slot extending at an angle to said longitudinal direction of said roller skate, said guide slot comprising an inclined guide surface which slidingly supports said shaft, said actuation block and said braking member during pivotal movement thereof about said pivot axis, as said braking member moves into frictional contact with said at least one roller.

7. A braking device as claimed in claim 1, wherein the pivot axis of said actuation block is arranged to coincide with the roller axis of said at least one roller.

8. A braking device as claimed in claim 1, wherein the pivot axis of said actuation block is located rearwardly of the roller axis of said at least one roller.

9. A braking device as claimed in claim 1, wherein said braking member is a braking roller.

10. A braking device for a roller skate comprising a boot and a frame, said frame mounting rollers for rotation about respective parallel roller axes, said braking device comprising:

an actuation block including a bottom contact surface, said actuation block detachably mounted to one of said frame and said boot, for pivotal movement about a pivot axis from an inoperative position to an operative position against a force of a spring located between said actuation block and one of said frame and said boot acting to return said actuation block to the inoperative position, said pivot axis being generally parallel to the roller axes:

a braking roller associated with said actuation block and arranged to frictionally contact at least one of said rollers when said actuation block is pivoted to its operative braking position; and a guideway provided in at least one of said frame and said actuation block, to guide and support said actuation block and said braking roller during pivotal movement thereof relative to said frame and in the operative braking position thereof, and wherein said braking roller has as shaft which is slidingly guided in said guideway.

11. The device of claim 1 wherein said actuation block is mounted in a holder pivotally mounted to said frame, said guideway including a first slot in said frame and a second slot in said holder, said slots intersecting each other, and wherein said shaft passes through said braking member and is received in said slots.

12. A braking device for a roller skate having a plurality of rollers mounted on respective axles in a frame, said braking device comprising a brake holder pivotally mounted on the axle of a rearmost roller, said brake holder supporting a ground engaging actuation block and a roller engaging braking member; a spring located between said frame and said holder biasing said braking member to an inoperative position; intersecting slots provided in said frame and said holder and a shaft received in said intersecting slots and extending parallel to said pivot axis through said frame, said braking member and said brake holder, for guiding said holder and said braking member during pivotal movement of said holder about said pivot axis.

13. The braking device of claim 12 wherein said actuation block is integral with said braking member.

14. The braking device of claim 13 wherein said braking member is adapted to frictionally engage a running surface of the rearmost roller.

* * * * *